US009682576B2

(12) United States Patent
Musete

(10) Patent No.: US 9,682,576 B2
(45) Date of Patent: Jun. 20, 2017

(54) PRINTING ASSEMBLY

(71) Applicant: Océ-Technologies B.V., Venlo (NL)

(72) Inventor: Romeo Musete, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/241,289

(22) Filed: Aug. 19, 2016

(65) Prior Publication Data

US 2017/0066256 A1 Mar. 9, 2017

(30) Foreign Application Priority Data

Sep. 3, 2015 (EP) ..... 15183678

(51) Int. Cl.

| | |
|---|---|
| ***B41J 11/44*** | (2006.01) |
| ***B41J 15/08*** | (2006.01) |
| ***B41J 11/00*** | (2006.01) |
| ***B41J 15/04*** | (2006.01) |
| ***B41J 19/00*** | (2006.01) |
| ***B41J 25/00*** | (2006.01) |

(52) U.S. Cl.

CPC ..... *B41J 11/007* (2013.01); *B41J 11/001* (2013.01); *B41J 11/0095* (2013.01); *B41J 15/04* (2013.01); *B41J 19/00* (2013.01); *B41J 25/001* (2013.01); *B41J 25/003* (2013.01)

(58) Field of Classification Search

CPC . B41J 15/00; B41J 15/046; B41J 15/08; B41J 15/14; B41J 11/00; B41J 11/0095; B41J 15/10; B41J 15/12; B41J 11/04; B41J 11/44; B41J 11/46; B41J 29/38

See application file for complete search history.

(56) References Cited

U.S. PATENT DOCUMENTS

| | | | | |
|---|---|---|---|---|
| 2001/0014236 | A1* | 8/2001 | Hevenor | B41J 25/316 400/31 |
| 2002/0126169 | A1 | 9/2002 | Wyngaert et al. | |
| 2006/0092219 | A1* | 5/2006 | Kurita | B41J 2/04505 347/40 |
| 2010/0150632 | A1 | 6/2010 | Matsumoto et al. | |
| 2011/0235065 | A1 | 9/2011 | Wilson et al. | |

(Continued)

FOREIGN PATENT DOCUMENTS

EP 0992353 A1 4/2000

*Primary Examiner* — Geoffrey Mruk
*Assistant Examiner* — Scott A Richmond
(74) *Attorney, Agent, or Firm* — Birch, Stewart, Kolasch & Birch, LLP

(57) ABSTRACT

In a printer assembly for image-wise providing a recording substance on a recording medium, the printer assembly comprises a print surface for supporting the recording medium; a gantry supporting a print head; and a medium supply assembly for step-wise supplying the recording medium over the print surface in a medium transport direction. The print head is configured to provide a swath of the recording substance on the recording medium arranged on the print surface in a scanning direction. The gantry is rotatable in a plane substantially parallel to the print surface such that the scanning direction is rotatable relative to the medium transport direction. Thus, skewing of the recording medium may be compensated such to prevent visibility of banding due to misalignment of subsequently printed swaths.

9 Claims, 6 Drawing Sheets

(56) References Cited

U.S. PATENT DOCUMENTS

| | | | | |
|---|---|---|---|---|
| 2014/0015892 | A1* | 1/2014 | Chen | B41J 11/42 347/19 |
| 2014/0071201 | A1* | 3/2014 | Liberman | B41J 25/003 347/38 |
| 2015/0009262 | A1* | 1/2015 | Bell | B41J 15/046 347/37 |

* cited by examiner

PRINTING ASSEMBLY

FIELD OF THE INVENTION

The present invention generally pertains to a printing assembly configured to provide an image on a recording medium, wherein the recording medium is step-wise advanced over a print surface.

BACKGROUND ART

It is well-known in the art to provide a printing assembly wherein a recording medium is provided and step-wise advanced over a print surface in a medium transport direction. A print head provides a swath of a recording substance image-wise on the recording medium. Then, after a next stepping of the recording medium, an adjacent swath is provided. Swaths are positioned relative to each other as accurate as possible such to prevent that banding due to misalignment of adjacent swaths becomes visible.

Accurate positioning of adjacent swaths requires accurate control of the position of the recording medium after each step-wise advancement and accurate control of the print head position relative to the recording medium.

In another, well-known embodiment, the print head is arranged on a print head carriage. The print head carriage is arranged to scan over the recording medium in a scanning direction that is substantially perpendicular to the medium transport direction. Accurate control of the print head position relative to the recording medium and in particular relative to a previous swath becomes more challenging.

In a known embodiment, the print head is a stationary page-wide print head (i.e. a print head extending over the full width of a web of recording medium). In such embodiment the position control of the print head is relatively simple. Therefore, it known to arrange the print head rotatably such that a rotational error of the web may be compensated by rotating the page-wide print head. Similarly, it is known to rotate a support beam of a scanning print head to compensate for a stationary arranged recording substrate such to have a scanning direction of the print head corresponding to an orientation of the recording substrate.

With an increasing demand for high productivity and a broad recording medium range with different media types having different properties, also with respect to advancing and positioning, the requirements on the printing assembly are still increasing. In particular, in a printing assembly for printing on relatively wide (e.g. 64 inch (1.6 m) or wider), it is relatively expensive to provide for a page-wide print head or array of aligned print heads, while the positional and rotational errors exponentially increase due to flexibility in the recording medium or misalignment of guiding rollers.

It is therefore an object of the present invention to provide a printing assembly for printing on a web of recording medium and a corresponding printing method that are suitable to meet the demand for a versatile and productive printing assembly for printing on a wide-format web of recording medium.

SUMMARY OF THE INVENTION

In an aspect of the present invention, a printing assembly according to claim 1 is provided. In particular, the printing assembly is configured for image-wise providing a recording substance on a web of recording medium and the printer assembly comprises a print surface for supporting the recording medium, a gantry moveably supporting a print head for moving the print head in a scanning direction to provide a swath of the recording substance in the scanning direction on the recording medium arranged on the print surface, and a medium supply assembly for step-wise supplying the web of recording medium over the print surface in a medium transport direction. The gantry is rotatable in a plane substantially parallel to the print surface such that the scanning direction is rotatable relative to the medium transport direction.

In the printing assembly according to the present invention, the scanning direction is not predetermined, but rotatable relative to the medium transport direction. Misalignment of adjacent swaths due to step-wise advancement errors of the recording medium may be compensated by adapting the scanning direction. Thus, the requirements on the recording medium advancement assembly may be loosened. Similarly, recording medium types that are difficult to control during advancement, for example due to anisotropic behavior, may be used as misalignment in stitching the adjacent swaths can be prevented. Hence, the media versatility of the printing assembly may be increased. In general, the scanning direction is preferably perpendicular to the medium transport direction and a maximum rotation angle of the scanning direction may be limited, depending on the expected or accepted rotation of a part of the recording medium that is arranged on the print surface.

The present invention is very suitable for use with a print head or an array of print heads that record a swath of recording material, wherein the swath has a relatively large height as seen in the medium transport direction, as such a relatively large height will result in more visibility of any skew in the scanning direction relative to the medium transport direction. Also, the present invention is very suitable for use with a printing assembly for printing relatively wide recording mediums, i.e. having a relatively long swath in the scanning direction as a relatively small skew angle will have a relatively large absolute error in the medium transport direction making misalignment of adjacent swaths highly visible.

The present invention, in an embodiment, is very suitable to be used in combination with a relatively long print surface as seen in the medium transport direction. In such embodiment, the medium advancement step is larger than a swath height, requiring the print head to provide multiple swaths before the recording medium is advanced with a next step. In such embodiment, the print head needs to be moved in the medium transport direction between subsequent steps of the recording medium. Thereto, the gantry is translatable in the medium transport direction. Still, with such a large medium advancement step, a small skew angle may result in a large absolute position error of the recording medium. The printing assembly according to the present invention is enabled to compensate for such error. Moreover, such an embodiment is very suitable for productive printing.

In an embodiment, the printer assembly is further comprises a medium edge detecting assembly for detecting an edge of a print surface part of the recording medium, said print surface part of the recording medium being arranged on the print surface; and a gantry controller for controlling a rotational movement of the gantry, the gantry controller being operatively coupled to the medium edge detecting assembly. In such embodiment, the gantry controller is configured to control the gantry to rotate such that the scanning direction is substantially perpendicular to the edge of the print surface part of the recording medium. The edge of the recording medium may provide sufficient information regarding the position and any skew of the recording medium relative to the medium transport direction to enable to determine a desired angle of the scanning direction relative to the medium transport direction. Therefore, providing a suitable edge detecting assembly enables to determine a desired gantry position and orientation.

Such an edge detection system may advantageously comprise an optical scanner unit that may be arranged in the print surface or on the gantry.

In another embodiment, the printing assembly is provided with a swath edge detecting assembly for detecting an edge of a swath of recording substance, wherein said swath of recording substance is previously provided on the recording medium, and the printing assembly is provided with a gantry controller for controlling a rotational movement of the gantry, wherein the gantry controller is operatively coupled to the swath edge detecting assembly. In such embodiment, the gantry controller is configured to control the gantry to rotate such that the scanning direction is substantially parallel to the edge of the swath of recording substance. Thus, it is enabled to highly accurately position a subsequent swath adjacent to any previous swath, preventing visible swath banding.

In an embodiment, the medium supply assembly comprises a guiding roller configured for guiding the web of recording medium from a supply roll over the print surface to a receiving roll, wherein the guiding roller is provided with a central axis of rotation and the central axis of rotation is orientateable for steering a direction of movement of the web of recording medium. In the printing assembly according to the present invention, the web of recording medium may be supplied from a roll and be received on a receiving roll. Such rolls may support many meters of recording medium. If the movement of the web is not parallel to the medium transport direction, the skew may be initially compensated by the rotation of the gantry. However, such skew may increase with subsequent media transport steps. With continuing increase of skew, the web of recording medium will be uncontrollable and/or the gantry rotation will become insufficient for compensating the skew. Therefore, in this embodiment, at least one of the guide rollers may be repositioned and its orientation may be adapted to correct the position of the web of recording medium by steering the web during a next medium transport step. It is noted that steering a web of recording medium in response to a detected skew is well-known in the art and is therefore not elucidated in further detail herein.

In another aspect of the present invention, a method for image-wise providing a recording substance on a web of recording medium using a printer assembly is provided. The printer assembly comprises a print head moveably supported by a gantry for moving in a scanning direction and the method comprises step-wise supplying the web of recording medium over a print surface of the printer assembly in a medium transport direction, rotating a gantry of the printer assembly in a plane substantially parallel to the print surface such to orientate the gantry in the scanning direction; and providing a swath of the recording substance on the web of recording medium by controlling the print head to provide the swath of recording substance, the swath extending in the scanning direction.

In an embodiment of the method according to the present invention, the printer assembly comprises at least one of a medium edge detecting assembly and a swath edge detection assembly; and a guiding roller configured for guiding the web of recording medium from a supply roll over the print surface to a receiving roll, wherein the guiding roller is provided with a central axis of rotation and the central axis of rotation is orientateable for steering a direction of movement of the web of recording medium. In such embodiment, the step of rotating the gantry comprises determining a suitable scanning direction based on a detection result of said at least one of the medium edge detection assembly and the swath edge detection assembly and comprises rotating the gantry into an orientation corresponding to the determined suitable scanning direction. This embodiment of the method further comprises orientating the central axis of rotation of the guiding roller in response to the determined suitable scanning direction for steering the web of recording medium in a subsequent step of step-wise supply of recording medium to a desired orientation on the print surface.

In an embodiment, the print surface extends in the medium transport direction over a distance that is more than a width of the swath, wherein the gantry is translatable in the medium transport direction. In such embodiment, the step of providing a swath of recording substance comprises translating the gantry in the medium transport direction and providing at least one further swath of the recording substance prior to returning to the step of supplying the web of recording medium. Thus, there is no need to supply the recording medium after each scanning movement of the print head. Thus, the effective recording speed may be increased, i.e. the total time of completing an image may be reduced, since accurately step-wise transporting a web of recording medium takes a relatively long time.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not !imitative of the present invention, and wherein.

DETAILED DESCRIPTION OF THE DRAWINGS

Figure 1A:
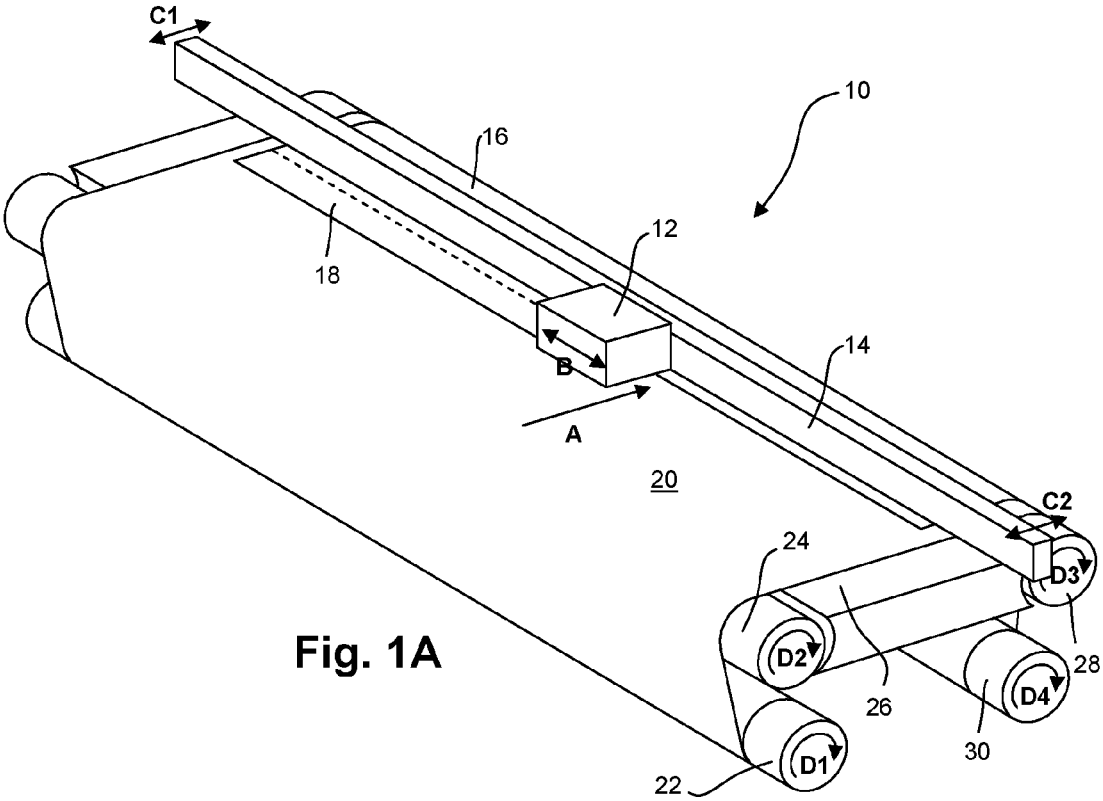
FIG. 1A shows a perspective view of a first embodiment of a printing assembly according to the present invention.

The present invention will now be described with reference to the accompanying drawings, wherein the same reference numerals have been used to identify the same or similar elements throughout the several views.

Figure 1B:
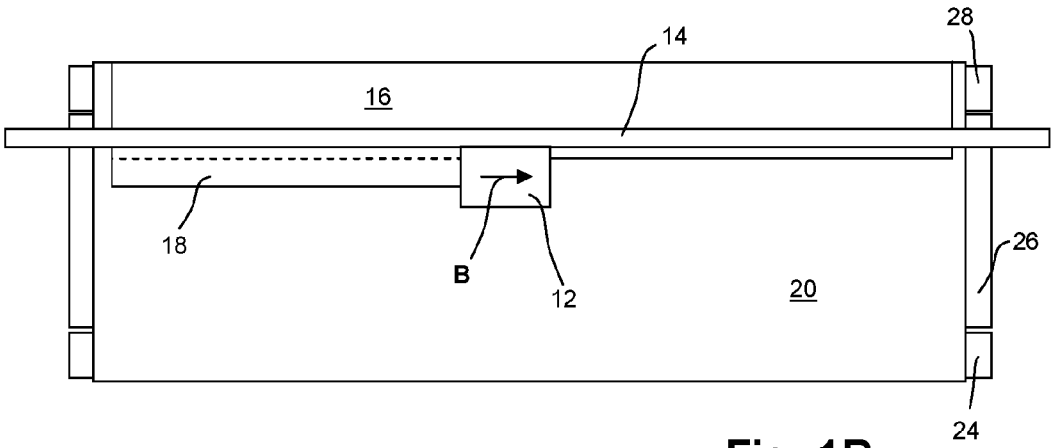
FIG. 1B shows a top view of the embodiment of FIG. 1A.

A first embodiment of a printing assembly 10 according to the present invention is shown in FIGS. 1A and 1B. The printing assembly 10 comprises a scanning print head carriage 12 supported by a gantry 14. The carriage 12 carries a number of print heads, such as inkjet print heads, while other kinds of print heads are contemplated too. The print heads are configured to provide a recording substance on a medium 20 by image-wise providing dots of the recording substance on the recording medium 20. The carriage 12 scans along a scanning direction B such to position the print heads over each position on the recording medium 20 and a controller (not shown) is configured to drive the print heads to provide for image dots corresponding to an image to be printed. With a scanning movement of the carriage 12 along the gantry 14, the print heads are enabled to provide for a swath 18 of recording substance on the recording medium 20. When the swath 18 is provided on the recording medium 20, the recording medium 20 may be advanced in a medium transport direction A to enable the print heads to provide for an adjacent swath 18 thereby building up a printed image 16.

In the illustrated embodiment, the recording medium 20 is a web of recording medium 20, for example a paper medium, supplied from a supply roll 22. The present invention is however not limited to such roll-fed webs. The mediums applied may as well be sheets or board-like mediums being step-wise advanced through the printing assembly 10 for printing, wherein skewing of the recording medium 20 may occur during advancement.

In the illustrated embodiment, the web of recording medium 20 is transported over a first transport roller 24, a print surface 26 and over a second transport roller 28. Then, the recording medium 20 is received on a receiving roll 30. The supply roll 22, the transport rollers 24, 28 and the receiving roll 30 each rotate around their respective axes as indicated by arrows D1, D2, D3 and D4. Each roll 22, 30 and each transport roller 24, 28 may be actively driven by a suitable actuator to advance the recording medium 20, but in an embodiment only some of the rolls 22, 30 and/or transport rollers 24, 28 may be driven. Methods to transport a recording medium 20 from a supply roll 22 to a receiving roll 30 over a print surface 26 are well known in the art and a detailed description of such method and corresponding configuration of the printing assembly 10 for such method is herein omitted.

The print surface 26 may be any flat surface supporting the recording medium 20, while the recording substance, such as ink or toner, may be applied on the recording medium 20. As known from the art, the print surface 26 may be provided with means for keeping the recording medium 20 flat on the print surface 26. For example, a pattern of suction holes may be provided such to suck the recording medium 20 onto the print surface 26. In such embodiment, the suction may be reduced during medium advancement or the suction may be kept to a level not disturbing a medium advancement between printings of the swaths 18.

As known from the prior art, it may be preferred to arrange the scanning direction B perpendicular to the medium transport direction A. In this way, it is expected that the subsequent swaths 18 are positioned adjacent to each other without showing artifacts.

As used herein, artifacts refer any artifacts resulting from inaccurate positioning a subsequent swath 18 relative to previously printed swaths (in FIGS. 1A and 1B shown as printed image 16). Such a printing method design requires the recording medium 20 to be accurately advanced in the medium transport direction A. With increasing speeds and productivity, the demands on the recording medium advancement elements, such as the rolls 22, 30, the transport rollers 24, 28 and any elements and devices driving and supporting the recording medium 20 and the rolls and rollers 22, 24, 28 and 30, becomes high and result in increased costs, if at all feasible. On the other hand, there is a demand for reduced costs for printing. Hence, a commercially feasible printing assembly 10 needs a cost-effective medium transport assembly. The present invention is conceived with the aim to provide for such a cost-effective medium transport assembly suitable for use in a high-productivity printing assembly 10. The operation of the present invention is illustrated in and described herein below with reference to FIGS. 2A-2D.

Figure 2A:
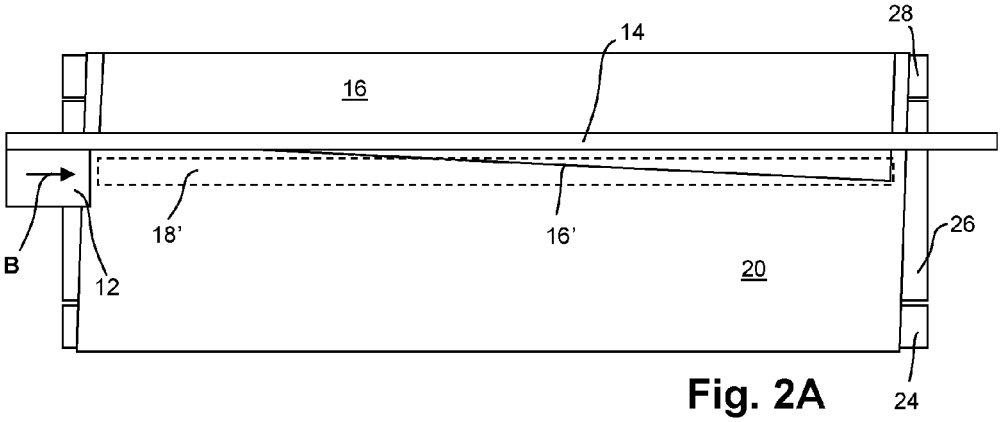
FIGS. 2A-2D show top views of the embodiment of FIG. 1A for illustrating an operation of the printing assembly.
Figure 2B:
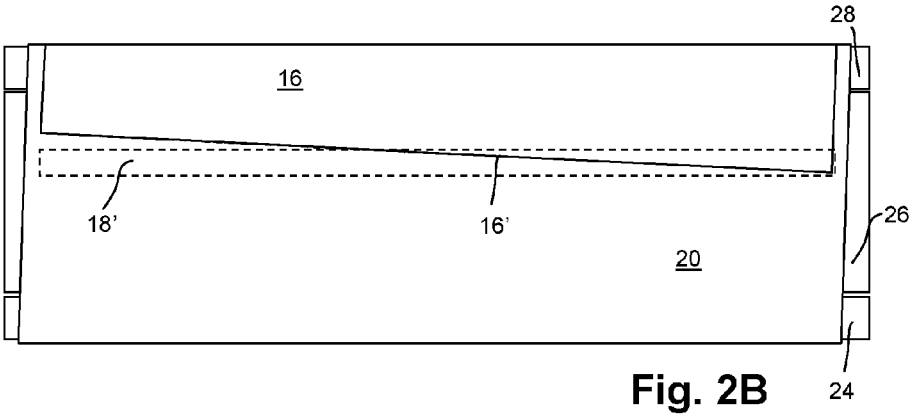
Figure 2C:
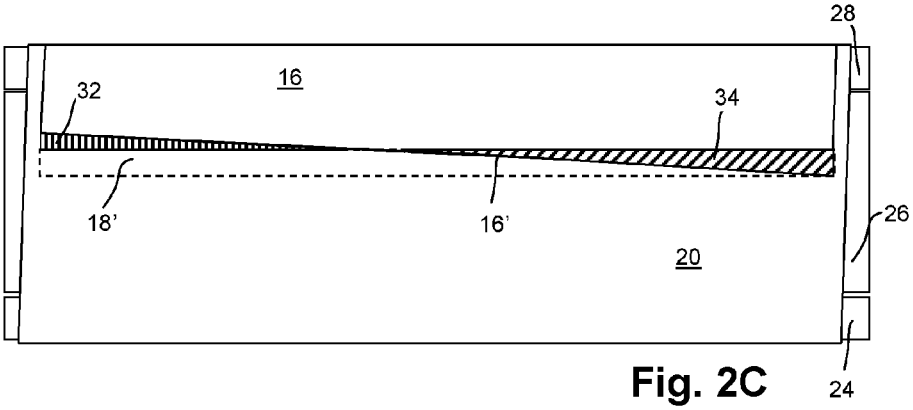

With a less accurate medium transport assembly, small errors during medium advancement may occur. For example, a minor skewing of the recording medium 20 may occur, which means that the medium transport direction A is effectively slightly rotated. This is shown in FIG. 2A, wherein a trailing edge 16' of the printed image 16 is slanted relative to the scanning direction B. A swath 18' to be printed in a subsequent scanning movement of the carriage 12 will partly overlap with the printed image 16 and will partly not be adjacent to the printed image 16. This is better shown in FIGS. 2B and 2C, in which the gantry 14 and the carriage 12 are omitted for illustrative purposes. In particular referring to FIG. 2C, an unprinted area 32 and a double printed area 34 will result. In the unprinted area 32, not image dots will be provided as the print heads will not be moved over this area 32. Consequently, presuming a white recording medium 20, a white unprinted area 32 will be clearly visible. In the double printed area 34, the print heads will be scanned twice and a double amount of image dots will be provided, resulting in a darkened area 34, which will also be clearly visible. Hence, the image quality significantly deteriorates with an inaccurate medium transport assembly.

Figure 2D:
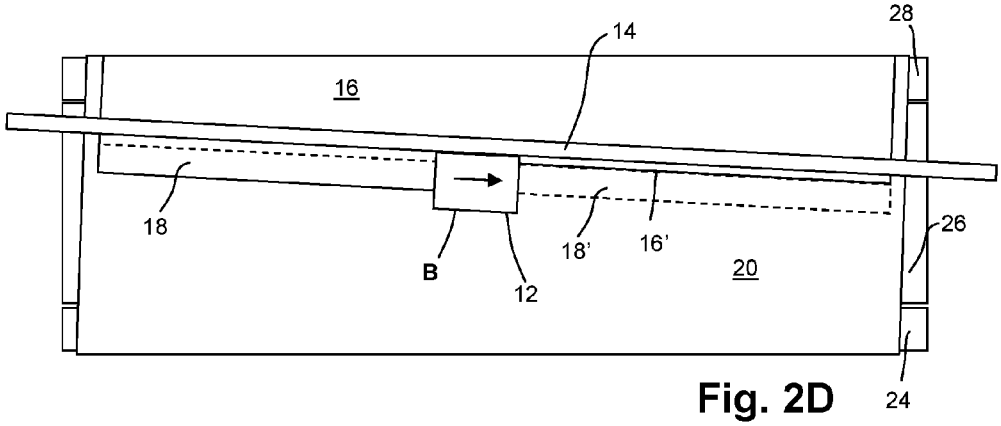

However, in accordance with the present invention and as shown in FIG. 2D, the gantry 14 may be rotated such to position the scanning direction B in parallel to the trailing edge 16' of the printed image 16. Thereto, as illustrated in FIG. 1A, one or both ends of the gantry 14 may be moveable in a gantry movement direction C1, C2 substantially parallel to the medium transport direction A. By suitably positioning the gantry 14, each swath 18 may be correctly and accurately positioned relative to the recording medium 20 and/or the trailing edge 16' of the printed image 16.

Of course, the skewing illustrated in FIGS. 2A-2D may be presumed to be exaggerated compared to practically feasible skewing angles. Still, FIGS. 2A-2D are intended for illustrative purposes. In practice, the recording medium 20 may have a width (i.e. the dimension in the scanning direction B) of 1.6 m or more; for example, printing assemblies for printing on a recording medium having a width of more than 3 m. and even upto 5 m. are well known in the art. With a suitably calibrated, cost-effective medium transport assembly, a deviation from the desired medium transport direction A may be in a range of tens of microns or maybe even a few hundreds of microns (i.e.

skew angles significantly smaller than 1 degree). Still, with common print resolutions of 600 dots per inch and higher, i.e. a dot spacing of 42 microns and smaller, deviations of some tens of microns from intended image dot positioning will be clearly visible in the printed image 16 and may result in unacceptable image quality.

Figure 3A:
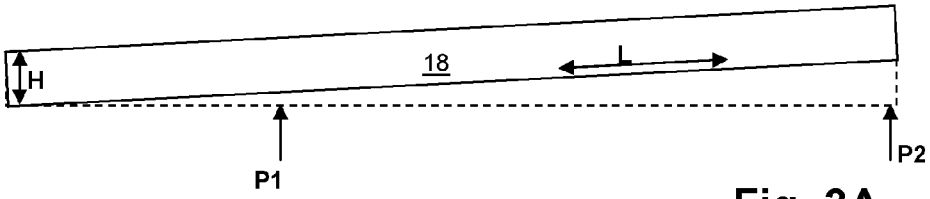
FIG. 3A-3B illustrate print artifacts occurring due to recording medium skewing.
Figure 3B:
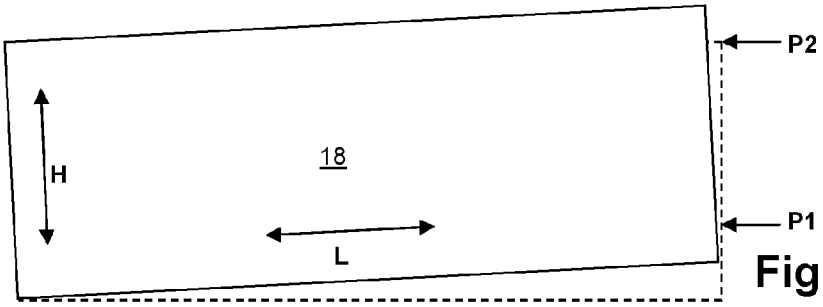

Referring to FIG. 3A, with increasing recording medium width, swath lengths L (i.e. the dimension of the swath 18 in the scanning direction B) are increasing. With increasing swath lengths L, an absolute dot positioning error due to a skew angle increase. For example, with a relatively short swath length L such as at position P1, a small deviation of the edge of the swath 18 is present. At the full length at position P2, however, a large deviation results. Similarly, as shown in FIG. 3B, an increased swath height H results in an increased deviation at position P2 compared to at the relatively small height at position P1. Still, with the demand for increased productivity and media versatility, swaths 18 with an increased length and/or increased height are needed. With the present invention, such increased length and height of the swaths 18 are feasible without compromising on image quality.

Figure 4:
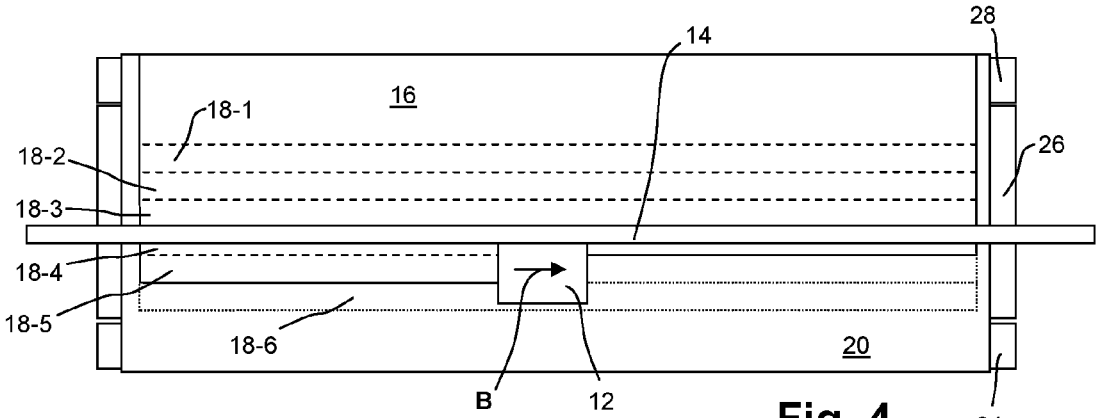
FIG. 4 shows a top view of a second embodiment of a printing assembly according to the present invention.

Moreover, the present invention enables a second embodiment as illustrated in FIG. 4. While in the known printer assemblies, the recording medium is advanced after every swath 18, in the second embodiment, the print surface 26 is enlarged and the printing assembly is configured to provide multiple adjacent swaths 18-1, 18-2, 18-3, 18-4, 18-5 and 18-6 before advancing the recording medium 20. Thereto, the gantry 14 with the carriage 12 is first positioned at a first side of the print surface 26 for providing a first swath 18-1. After printing of the first swath 18-1, the recording medium 20 is maintained stationary, while the gantry 14 is moved (translated in the medium transport direction A) and positioned such that a second swath 18-2 can be printed adjacent to the first swath 18-1. In the embodiment illustrated in FIG. 4, the print surface 26 has such a size that six swaths 18-1-18-6 may be printed before the recording medium 20 is advanced. In such embodiment, the gantry 14 needs to be accurately rotationally positioned only once per 6 swaths, which is beneficial for the overall time needed for printing, i.e. increasing the productivity.

Figure 5A:
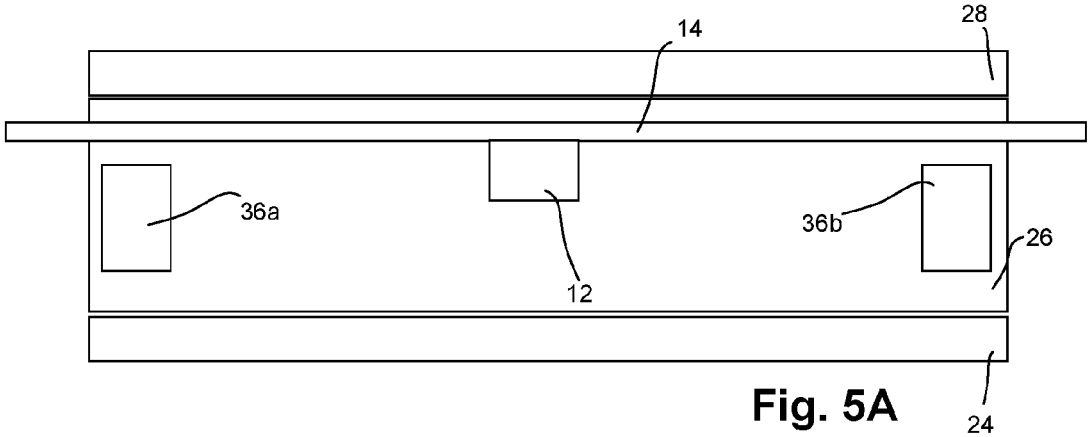
FIGS. 5A-5C illustrate in top view a third, fourth and fifth embodiment of a printing assembly according to the present invention.

For determining a desired orientation of the gantry 14 corresponding to a desired orientation of the scanning direction B, an orientation of the recording medium 20 may be determined, for example by using a medium edge detecting assembly, and/or an orientation of an edge 16' (FIG. 2A) of a previous swath may be determined. FIG. 5A illustrates an exemplary embodiment suitable for detecting an edge of the recording medium 20. In the embodiment of FIG. 5A, optical scanning means 36*a*, 36*b* are provided in the print surface 26 at a location where an edge of the recording medium 20 may be expected. In this embodiment, the optical scanning means 36*a*, 36*b* are provided near a left-hand and a right-hand side of the print surface 26. If the printing assembly is configured to print on a recording medium having a smaller width, the optical scanning means may be configured to extend more towards a centre of the print surface 26 or even span over the full width of the print surface 26.

A method for detecting the edge from an optical scanning result is well known in the art and skilled person is thus enabled to select a suitable method. Therefore, such a method is not further described herein. Depending on the method selected, the optical scanning means 36*a*, 36*b* may extend over the print surface 26 in the medium transport direction A as shown in FIG. 5A. In another embodiment, the optical scanning means 36*a*, 36*b* may be limited to a line CCD extending in the scanning direction B. In such embodiment, an orientation of the recording medium edge is derivable from a difference in a first scanning result and a subsequent second scanning result, which is apparent to those skilled in the art.

Figure 5B:
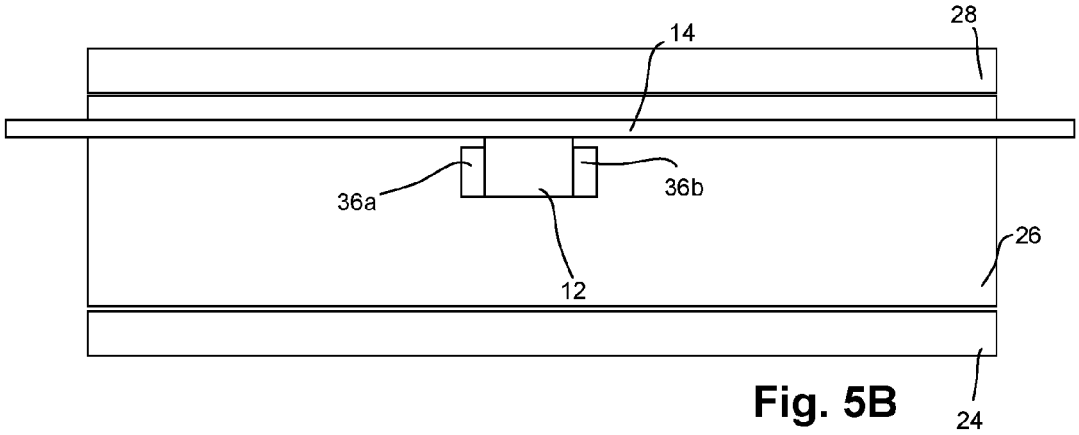

FIG. 5B illustrates another embodiment, wherein the optical scanning means 36*a*, 36*b* are arranged on the carriage 12. In particular, the optical scanning means 36*a*, 36*b* in this embodiment may be line COD's arranged in the medium transport direction A. By suitably moving the carriage 12 along the gantry 14 in the scanning direction B, a detailed scanning result is obtainable. For example, a first scan at a left-hand side of the print surface 26 and a second scan at a right-hand side of the print surface 26 may be obtained by positioning the carriage 12 correspondingly. From the first scan and the second scan, it may be derived where the recording medium 20 is positioned and how it is oriented. Other methods may be suitable, too, as is apparent to those skilled in the art.

Figure 5C:
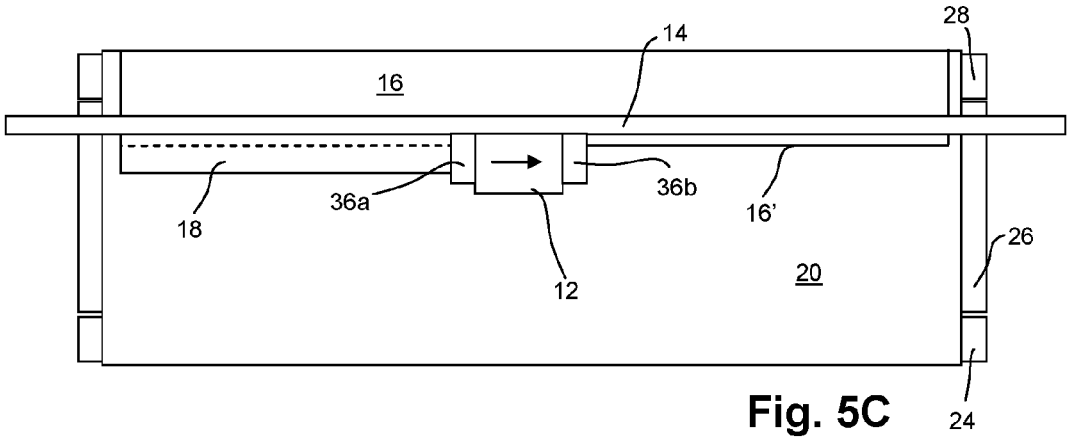

FIG. 5C illustrates another embodiment, wherein the optical scanning means 36*a*, 36*b* are arranged on the carriage 12, similar to the embodiment of FIG. 5B. In the embodiment of FIG. 5C, the optical scanning means 36*a*, 36*b* are configured to determine a position and orientation of the trailing edge 16' of the printed image 16. The swath 18 being printed can easily be accurately positioned relative to the trailing edge 16' providing a high quality of the printed image 16 with virtually no visibility of swath banding (i.e. banding due to misalignment of adjacent swaths relative to each other). In an embodiment, as the assemblies of FIGS. 5B and 5C may be identical, the method for determining a desired gantry orientation, i.e. a desired scanning direction B, may include both a medium edge detection and a trailing edge detection and combining both to an optimal result based on minimizing swath banding and positioning the printed image on the recording medium 20. In particular with an anisotropic recording medium 20 that may stretch differently over its width, such a method may be advantageous.

Figure 6:
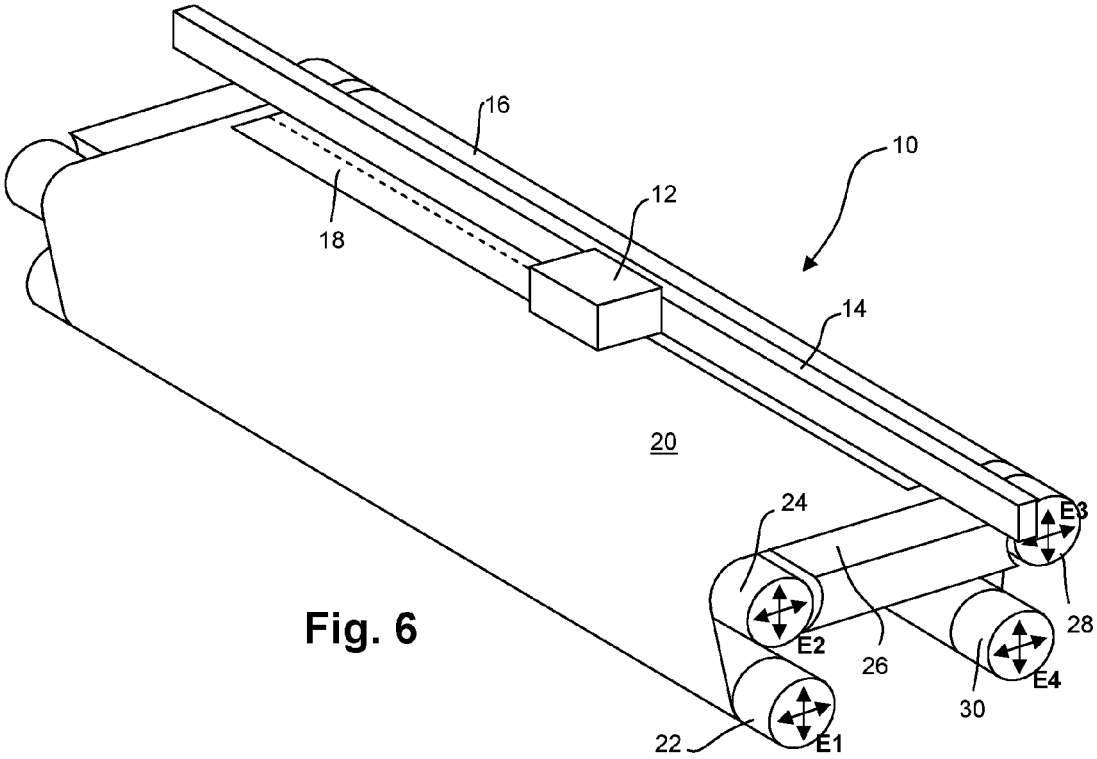
FIG. 6 shows a perspective view of a sixth embodiment of a printing assembly according to the present invention.

FIG. 6 illustrates a further embodiment of the present invention, wherein the gantry 14 may be rotated to determine a scanning direction B and wherein the medium transport assembly is configured to be adapted to the actual transport of the recording medium 20. In particular, in the embodiment of FIG. 6, one or more guiding rollers of the medium supply roll 22, the transport rollers 24, 28 and the receiving roll 30 are arranged such that the position and/or orientation of their respective central axes of rotation may be adapted. For example, when it is detected that the recording medium 20 is skewed, the gantry 14 is moved such that the scanning direction B becomes perpendicular to the edge of the recording medium 20. Then, when the recording medium 20 is transported again, the position and orientation of at least one of the rollers 22, 24, 28, 30 is changed in order to correct the skewing of the recording medium 20.

FIGS. 7A-7E illustrates a seventh embodiment, wherein the rotational freedom of the gantry allows a further printing mode. While in the first to sixth embodiments described above the image is build of swaths that are subsequently applied, while the web of recording medium was step-wise transported, the seventh embodiment includes a printing mode wherein the web of recording medium 20 is continuously moved.

Consequently, while the carriage 12 including the print head is moved in a scanning direction B1, the web of recording medium 20 simultaneously moves in the medium transport direction A.

Figure 7A:
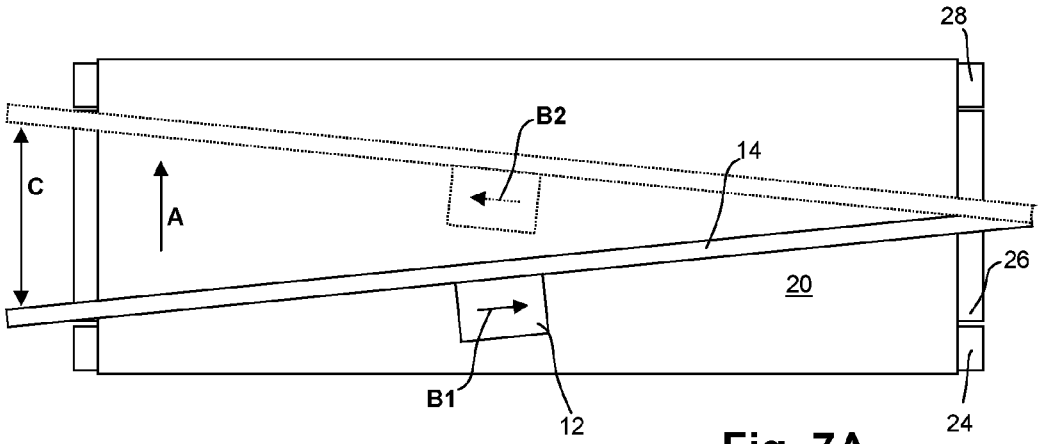
FIGS. 7A-7E show respective top views of a seventh embodiment for illustrating another printing mode of the printing assembly.

In particular, as shown in FIG. 7A, the gantry 14 is oriented in a first scanning direction B1, when applying the recording substance during a first scanning movement. The first scanning direction has a component corresponding to the medium transport direction A such that an applied swath may be substantially perpendicular to the medium transport direction A, taking into account the fact that the recording medium 20 is constantly moving during the first scanning movement.

After the first scanning movement, the gantry 14 is rotated by translating one end of the gantry 14 in accordance with arrow C. It is noted that in corresponding embodiments, both ends may be moved and rotated, depending on the requirements.

In a second scanning movement in the second scanning direction B2 a subsequent swath is applied adjacent to the swath applied in the first scanning movement, for example. In another embodiment, the second swath may be a second pass over the area of the first scanning movement, such that a two-pass printing strategy is executed. In another embodiment, the first pass and the second pass may partially overlap in accordance with a preselected printing strategy. Any printing strategy, many of which are known from the prior art, may be applied.

After performing the second scanning movement, the end of the gantry 14 is returned in accordance with arrow C and the printing method may continue with another scanning movement in the first scanning direction, again. FIGS. 7B-7E illustrate this printing method in more detail.

Figure 7B:
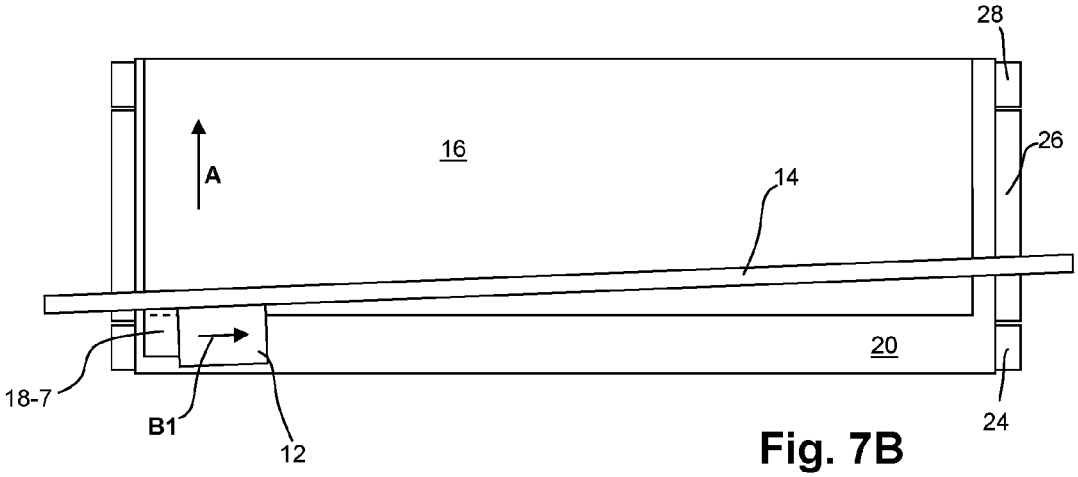
Figure 7C:
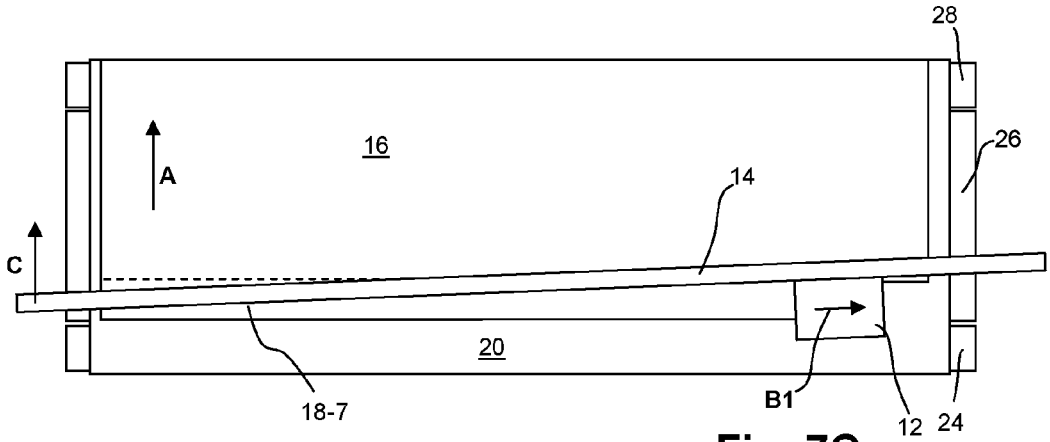

In FIG. 7B, the gantry 14 is positioned for performing a scanning movement of the carriage 12 in the first scanning direction B1, while the recording medium 20 is moved in the medium transport direction A. A first swath 18-7 is provided by application of the recording substance adjacent to a trailing edge of a previously provided image 16. The first scanning direction B1, the speed of movement of the carriage 12 and the speed of movement of the recording medium 20 are selected such that the recording substance is provided adjacent to said trailing edge. As illustrated in FIG. 7C, at the end of the scanning movement in the first scanning direction B1, the first swath 18-7 is positioned adjacent to said trailing edge. Then, one end of the gantry 14 is moved over a distance indicated by arrow C thereby rotating.

Figure 7D:
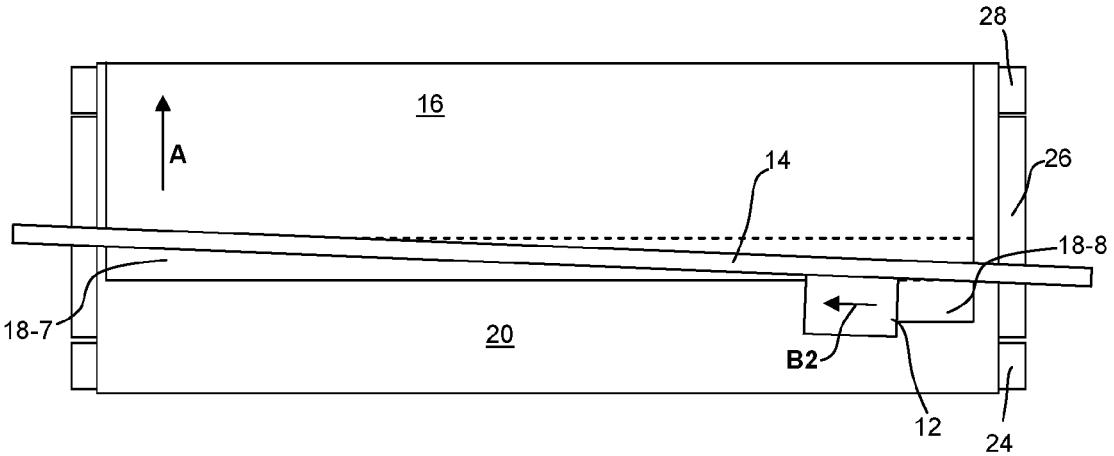
Figure 7E:
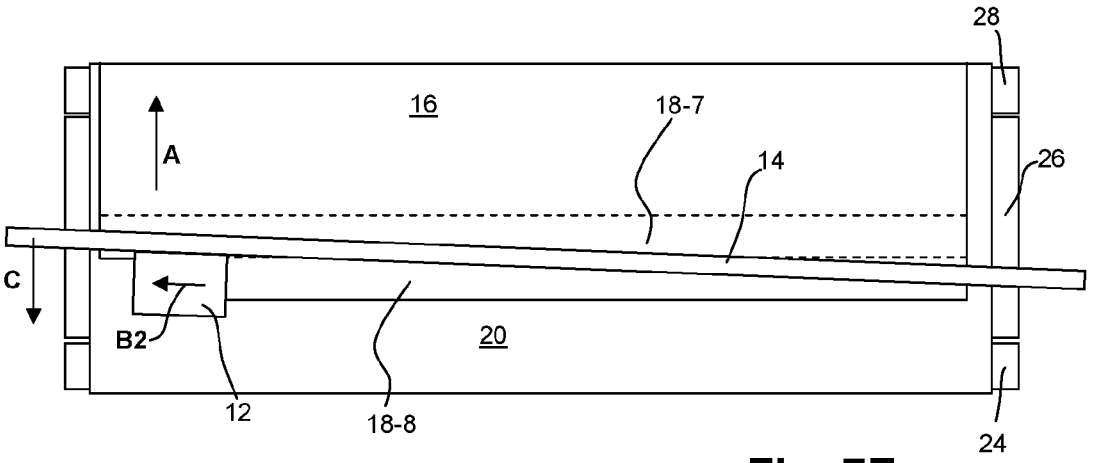

In FIG. 7D, the gantry 14 has rotated and the carriage 12 is moving in the second scanning direction B2. A second swath 18-8 is being applied adjacent to the first swath 18-7. Similar to the operation illustrated in FIG. 7B, the second scanning direction B2, the speed of movement of the carriage 12 and the speed of movement of the recording medium 20 are selected such that the recording substance is provided adjacent to a trailing edge of the first swath 18-7. Referring also to FIG. 7E, after application of the second swath 18-8, said one end of the gantry 14 returns to its original position in accordance with arrow C. Then, a next adjacent swath may be provided by a scanning movement in the first scanning direction B1, again, corresponding to the operation illustrated in FIG. 7B.

In the seventh embodiment of FIGS. 7A-7E, the recording medium 20 is continuously moved, preventing acceleration and deceleration, which reduces the positioning accuracy of the recording medium tremendously. The printing method according to the seventh embodiment may be provided as a high-speed printing mode next to one or more of the first to sixth embodiments, since the seventh mode is enabled by the printing assembly according to the present invention. Of course, the seventh embodiment may be provided separate from the methods of the first to sixth embodiments as well.

It is noted that a hybrid printing mode is enabled, too. For example, a slow and highly accurate medium transport step during which one or more swaths are printed in accordance with the seventh embodiment may be combined with the second embodiment of FIG. 4, wherein the recording medium is not moved, but multiple swaths are printed before the recording medium 20 is moved again. This hybrid embodiment enables to use very low acceleration and deceleration of the recording medium 20, while maintaining a high effective recording speed (i.e. a short total time for recording an image), since the printing assembly is still productive during step-wise advancement of the recording medium 20.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printer assembly for image-wise providing a recording substance on a web of recording medium, the printer assembly comprising:

a print surface for supporting the web of recording medium;

a gantry moveably supporting a print head for moving the print head in a scanning direction to provide a swath of the recording substance in the scanning direction on the recording medium arranged on the print surface;

a medium supply assembly for step-wise supplying the web of recording medium over the print surface in a medium transport direction;

a guiding roller configured for guiding the web of recording medium from a supply roll over the print surface to a receiving roll, wherein the guiding roller is provided with a central axis of rotation and the central axis of rotation is orientateable for steering a direction of movement of the web of recording medium; and a gantry controller configured to control a rotational movement of the gantry and to orient the central axis of rotation of the guiding roller in response to a determined suitable scanning direction for steering the web of recording medium to a desired orientation on the print surface, and wherein the gantry is rotatable in a plane substantially parallel to the print surface such that the scanning direction is rotatable relative to the medium transport direction.

2. The printer assembly according to claim 1, wherein the gantry is translatable in the medium transport direction.

3. The printer assembly according to claim 1, wherein the printer assembly further comprises:

a medium edge detecting assembly for detecting an edge of a print surface part of the recording medium, said print surface part of the recording medium being arranged on the print surface, wherein the gantry controller is operatively coupled to the medium edge detecting assembly, and wherein the gantry controller is configured to control the gantry to rotate such that the scanning direction is substantially perpendicular to the edge of the print surface part of the recording medium.

4. The printer assembly according to claim 3, wherein the medium edge detecting assembly comprises an optical scanner unit supported by the gantry for optically detecting the edge of the recording medium.

5. The printer assembly according to claim 3, wherein the medium edge detecting assembly comprises an optical scanner unit arranged in the print surface for optically detecting the edge of the recording medium.

6. The printer assembly according to claim 1, wherein the printer assembly further comprises:

a swath edge detecting assembly for detecting an edge of a swath of recording substance, said swath of recording substance previously provided on the recording medium, wherein the gantry controller is operatively coupled to the swath edge detecting assembly, and wherein the gantry controller is configured to control the gantry to rotate such that the scanning direction is substantially parallel to the edge of the swath of recording substance.

7. The printer assembly according to claim 1, wherein the printing assembly is provided with a first printing mode and a second printing mode, and wherein:

in the first printing mode, the recording medium is kept stationary during application of the swath; and in the second mode, the recording medium is moved constantly during application of the swath, while the gantry is rotated such that the applied swath is adjacent to a previously applied swath.

8. A method for image-wise providing a recording substance on a web of recording medium using a printer assembly, the printer assembly comprising a print head moveably supported by a gantry for moving in a scanning direction, the method comprising the steps of:

a. step-wise supplying the web of recording medium over a print surface of the printer assembly in a medium transport direction;

b. rotating a gantry of the printer assembly in a plane substantially parallel to the print surface such to orientate the gantry in the scanning direction; and c. providing a swath of the recording substance on the web of recording medium by controlling the print head to provide the swath of recording substance, the swath extending in the scanning direction, wherein the printer assembly comprises:

at least one of a medium edge detecting assembly and a swath edge detection assembly; and a guiding roller configured for guiding the web of recording medium from a supply roll over the print surface to a receiving roll, wherein the guiding roller is provided with a central axis of rotation and the central axis of rotation is orientateable for steering a direction of movement of the web of recording medium;

wherein step b. comprises determining a suitable scanning direction based on a detection result of said at least one of the medium edge detection assembly and the swath edge detection assembly and comprises rotating the gantry into an orientation corresponding to the determined suitable scanning direction; and wherein the method further comprises:

d. orientating the central axis of rotation of the guiding roller in response to the determined suitable scanning direction for steering the web of recording medium in a subsequent step a. to a desired orientation on the print surface.

9. The method according to claim 8, wherein the print surface extends in the medium transport direction over a distance that is more than a width of the swath, wherein the gantry is translatable in the medium transport direction and wherein step c. of the method comprises translating the gantry in the medium transport direction and providing at least one further swath of the recording substance prior to returning to step a.

* * * * *